US011271351B1

(12) United States Patent
Chen

(10) Patent No.: US 11,271,351 B1
(45) Date of Patent: Mar. 8, 2022

(54) COMBINED WALL OUTLET EXTENDER AND REMOTE CONTROL LIGHT

(71) Applicant: SHENZHEN ANHAORUIHE ELECTRONICS CO., LTD, Shenzhen (CN)

(72) Inventor: Xinhe Chen, Shenzhen (CN)

(73) Assignee: SHENZHEN ANHAORUIHE ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/524,724

(22) Filed: Nov. 11, 2021

(51) Int. Cl.

| | |
|---|---|
| ***H01R 33/00*** | (2006.01) |
| ***H01R 31/02*** | (2006.01) |
| ***H01R 31/06*** | (2006.01) |
| ***H01R 13/717*** | (2006.01) |
| ***H01R 13/453*** | (2006.01) |

(52) U.S. Cl.
CPC ..... *H01R 31/02* (2013.01); *H01R 13/4534* (2013.01); *H01R 13/717* (2013.01); *H01R 31/06* (2013.01)

(58) Field of Classification Search
CPC .... H01R 31/02; H01R 31/06; H01R 13/4534; H01R 13/717; H02G 3/14
See application file for complete search history.

(56) References Cited

U.S. PATENT DOCUMENTS

| | | | | |
|---|---|---|---|---|
| 4,674,813 | A * | 6/1987 | Feldner | H01R 13/6397 439/133 |
| 5,094,630 | A * | 3/1992 | Jammet | H01R 31/02 439/652 |
| 5,605,466 | A * | 2/1997 | Devlin | H01R 13/447 439/144 |
| 8,834,210 | B2 * | 9/2014 | Brausen | H01R 13/7135 439/718 |
| 9,461,419 | B2 * | 10/2016 | Hector, Jr. | H01R 25/003 |
| 9,509,080 | B1 * | 11/2016 | Insalaco | H01R 24/30 |
| 9,525,232 | B1 * | 12/2016 | Insalaco | H01R 24/30 |
| 10,516,240 | B1 * | 12/2019 | Insalaco | H01R 13/748 |
| 10,594,096 | B2 * | 3/2020 | Rahner | H01R 25/006 |

* cited by examiner

*Primary Examiner* — Thanh Tam T Le

(57) ABSTRACT

A combined wall outlet extender and remote control light relates to a field of lighting equipment and includes a lower cover, an upper cover arranged on the lower cover and matched with the lower cover, insert pins arranged on the lower cover, a power cord configured to connect with a light strip and arranged on a bottom portion of the upper cover, and an infrared receiver passing through the upper cover. A protective cover is arranged on the upper cover. The protective cover protects components arranged on the upper cover. A fixing pin is arranged on the lower cover. The upper cover and an upper end of the lower cover are combined to form a slot. A lampshade, button caps, USB interface through holes, and AC output port through holes are arranged on the upper cover. A main control PCB is arranged on the lower cover.

8 Claims, 10 Drawing Sheets

COMBINED WALL OUTLET EXTENDER AND REMOTE CONTROL LIGHT

TECHNICAL FIELD

The present disclosure relates to a field of lighting equipment technology, and in particular to a combined wall outlet extender and remote control light.

BACKGROUND

Colored lights are now widely used in a market. However, each color light needs to be equipped with an adapter and a control panel. In general, there are multiple color lights in a family, so multiple adapters and multiple control panels are needed, which wastes many resources and brings a lot of trouble and inconvenience during use. Further, a control method of the colored lights is too single. The related art provides a combined wall outlet extender and colored light that combines multiple functions such as an adapter, a controller, AC output ports, USB ports, etc. Lighting effect of a colored light is controlled by a mobile phone, or main buttons and a control panel installed on the combined wall outlet extender and colored light, which makes the colored light convenient, safe, simple and widely used. However, this kind of combined wall outlet extender and colored light is easy to be loose and not stable enough when plugged into a wall. Therefore, in view of defects in the related art, it is urgent to propose a combined wall outlet extender and remote control light to overcome shortcomings in current practical applications.

SUMMARY

The present disclosure aims to solve problems that conventional colored lights have a complex structure, waste many resources in the application process, a method of controlling the colored lights is too single, and a conventional combined wall outlet extender and colored light is easy to loosen and not stable enough on the wall.

A purpose and effect of a combined wall outlet extender and remote control light of the present disclosure is achieved by following solutions.

The combined wall outlet extender and remote control light comprises a lower cover, an upper cover arranged on the lower cover and matched with the lower cover, insert pins arranged on the lower cover, a power cord configured to connect with a light strip and arranged on a bottom portion of the upper cover, and an infrared receiver passing through the upper cover. A protective cover is arranged on an upper end of the upper cover. The protective cover is configured to protect components arranged on the upper cover. A fixing pin is arranged on the lower cover.

Furthermore, sliding grooves are arranged on a left side and a right side of the upper cover. Each of the sliding grooves comprises an upper section and a lower section. A cross section of the upper section of each of the sliding grooves is circular. A cross section of the lower section of each of the sliding grooves is rectangular. Convex blocks are fixedly connected with a left side and a right side of the protective cover. Each of the convex blocks is rotatably connected with a corresponding upper section of the sliding grooves. Each of the convex blocks is slidably connected with a corresponding lower section of the sliding grooves. The protective cover further comprises a buckle, and an opening matched with the buckle is defined on the upper cover. A position of the opening is corresponding to the buckle.

Furthermore, the upper cover and an upper end of the lower cover are combined to form a slot. A lampshade, button caps, USB interface through holes, and alternating current (AC) port through holes are arranged on the upper cover.

Furthermore, a main control print circuit board (PCB) is fixedly installed in the lower cover. An indicator light is arranged on the main control PCB. The lampshade is arranged on a position of the upper cover corresponding to the indicator light. USB Interfaces are welded with the main control PCB. The USB interfaces are built in the upper cover corresponding to a position of the USB interface through holes. AC output ports are welded with the main control PCB. The AC output ports are built in the upper cover corresponding to a position of the AC output port through holes. The insert pins are electrically connected with the AC output ports. A remote control PCB is arranged in the lower cover. Buttons are welded with the remote control PCB. The button caps are arranged on a position of the upper cover corresponding to the buttons. The infrared receiver is welded with the remote control PCB and the infrared receiver is built in the upper cover. The remote control PCB is welded with a female wiring terminal. The power cord is plugged into the female wiring terminal.

Furthermore, a rear frame is fixedly connected with the lower cover, a front frame is arranged on the rear frame. A horizontal rod is vertically slidably connected with the rear frame. A vertical rod is horizontally slidably connected with the front frame. A positioning block slidably connected with the vertical rod and the horizontal rod is arranged on the horizontal rod. The fixing pin is fixedly connected with the positioning block.

Furthermore, the rear frame is separated from the front frame. The front frame is slidable resettable connected with the rear frame. The front frame comprises connecting frames slidably connected with two sides of the lower cover. Locking openings are on the connecting frames. Locking blocks are slidably connected with two sides of the upper cover. An upper end of each of the locking blocks is hinged to a rotation center of a corresponding convex block arranged on the protective cover. A lower end of each of the locking blocks is matched with a corresponding locking opening of the connecting frames. A sliding block is slidably connected with the positioning block. The sliding block is slidably connected with the vertical rod. The fixing pin is hollow. A fastening mechanism arranged in the fixing pin is fixedly connected with the sliding block.

Furthermore, the fastening mechanism comprises an inner core, and the inner core arranged in the fixing pin is fixedly connected with the sliding block. A plurality of first abutting blocks are arranged on a left side and a right side of the inner core. A plurality of second abutting blocks corresponding to the plurality of first abutting blocks are arranged on inner sides of the fixing pin. The fixing pin is made of elastic deformable materials.

Furthermore, a plurality of clamping strips are arranged on two outer sides of the fixing pin.

Furthermore, the fastening mechanism comprises an inner core, the inner core arranged in the fixing pin is fixedly connected with the sliding block. Limiting bars are arranged on an upper side and a lower side of the inner core. The limiting bars are made of elastic deformable materials. Limiting blocks matched with the limiting bars are arranged on the fixing pin. When the inner core moves, the limiting bars deform and slide on the limiting blocks to extend out of the fixing pin.

The present disclosure provides the combined wall outlet extender and remote control light. The combined wall outlet extender and remote control light is formed by combining multiple functions such as functions of an adapter, a controller, the AC output ports, and the USB interfaces.

The combined wall outlet extender and remote control light comprises the power cord. By detachably connecting the light strip to the power cord, when the light need to be replaced, a user only have to disassemble and replace the light strip. Therefore, in the present disclosure, the combined wall outlet extender and remote control light is able to control any different light strips connected with the power cord by a same adapter and a same controller to avoid a need to replace the adapter and the controller at the same time when replacing conventional colored lights, thus saving resources and making the present disclosure environmentally friendly.

In the combined wall outlet extender and remote control light of the present disclosure, the USB interface through holes, the AC output port through holes, the infrared receiver, and button caps are arranged on the upper cover, and the slot configured to place a mobile device such as a mobile phone is formed on the upper cover and the lower cover, so that the light strip of the present disclosure is controlled by the mobile phone connected with the present disclosure via the USB interfaces, by infrared remote control, or by controlling the buttons. There are various ways to control the light strip, thereby avoiding the single method of controlling the light.

In the combined wall outlet extender and remote control light of the present disclosure, when the sliding block moves, it drives the inner core to move, which in turn drives the first abutting blocks on the inner core and the second abutting blocks on the fixing pin to abut against each other and move together. Since the fixing pin is made of elastic deformable materials, the fixing pin expands and deforms outward, thereby making the fixing pin expanding in a socket on a wall outlet and making the fixing pin clamping on the wall outlet tightly.

In the combined wall outlet extender and remote control light of the present disclosure, when the inner core moves, the limiting bars slide on the limiting blocks and deforms to extend out of the fixing pin. Therefore, when the combined wall outlet extender and remote control light has a tendency to loosen outward, the limiting bars fixed on the fixing pin are clamped on the socket of the wall outlet, thereby preventing the combined wall outlet extender and remote control light from loosening.

1—lower cover, 2—upper cover, 201—sliding groove, 3—protective cover, 301—buckle, 302—convex block, 4—slot, 5—insert pin, 6—power cord, 7—fixing pin, 701—inner core, 702—first abutting block, 703—second abutting block, 704—clamping strip, 705—limiting strip, 706—limiting block, 8—USB interface, 9—AC output port, 10—lampshade, 11—Infrared receiver, 12—button cap, 13—main control PCB, 14—remote control PCB, 15—button, 16—female wiring terminal, 17—front frame, 18—rear frame, 19—vertical rod, 20—horizontal rod, 21—connecting frame, 22—locking opening, 23—locking block, 24—positioning block, 25—sliding block; 26—USB interface through holes; 27—AC port through hole; 28—light strip.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Figure 1:
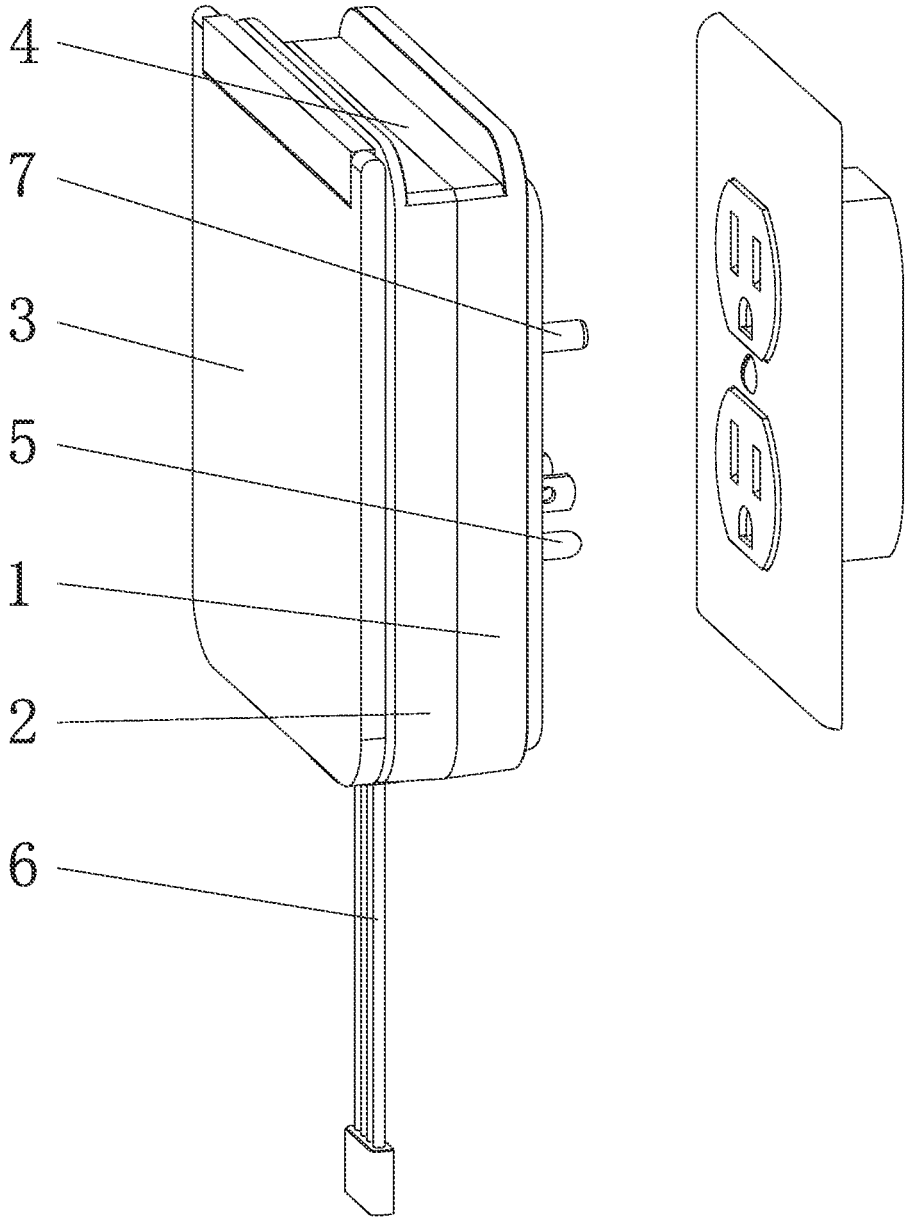
FIG. 1 is a front schematic diagram showing a structure of a combined wall outlet extender and remote control light without a light strip.
Figure 2:
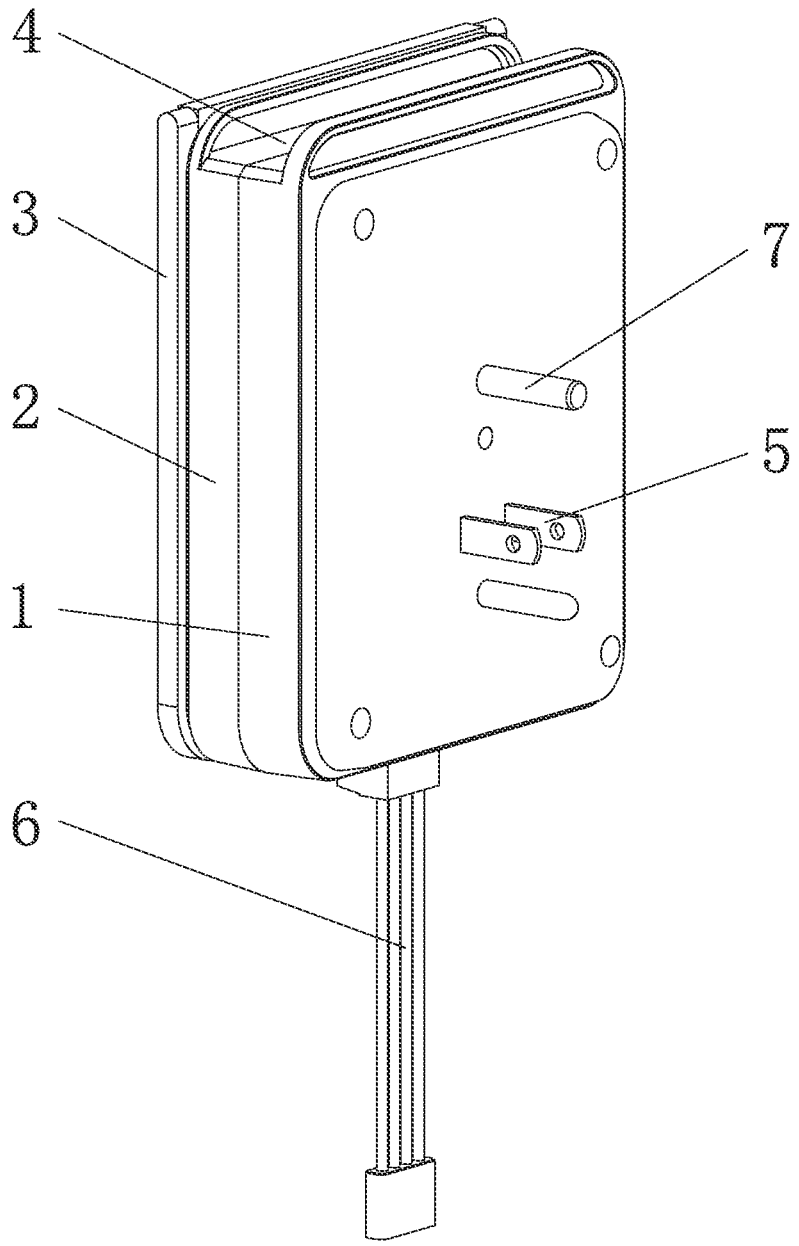
FIG. 2 is a rear schematic diagram showing the structure of the combined wall outlet extender and remote control light of the present disclosure without the light strip.

As shown in FIGS. 1-10, a combined wall outlet extender and remote control light comprises a lower cover 1 and an upper cover 2 arranged on the lower cover 2 and matched with the lower cover 1. The upper cover 2 and the lower cover 1 are detachably connected together by conventional connection methods such as buckle connection and threaded connection, which is not limited thereto. Insert pins 5 are arranged on the lower cover 1. Insert pins 5 comprises a live wire pin, a neutral wire pin, and a ground wire pin. The insert pins 5 form a conventional electrical plug. A power cord 6 configured to connect with a light strip is arranged on a bottom portion of the upper cover 2. The power cord 6 is detachably connect with the light strip, so when the light needs to be replaced, a user only need to replace the light strip 28. Thus, in the present disclosure, the combined wall outlet extender and remote control light is able to control any different light strips connected with the power cord by a same adapter and a same controller to avoid a need to replace the adapter and the controller at the same time when replacing conventional colored lights, thereby saving resources and making the present disclosure environmentally friendly, and further making use of the light simple. An infrared receiver 11 passes through the upper cover 2. The infrared receiver 11 is configured to receive an infrared signal from an external remote control device, and the external remote control device is configured to control the light strip 28. A protective cover 3 is arranged on an upper end of the upper cover 1. The protective cover 3 is configured to protect components arranged on the upper cover 2. The protective cover 3 covers an entire surface of the upper cover 2 to protect several components arranged on the upper cover 2. A fixing pin 7 is arranged on the lower cover 1. The fixing pin 7 is made of insulating materials. As shown in FIG. 1, the present disclosure is used on an indoor wall outlet. A most common type of indoor wall outlets is a duplex outlet, which is configured to connect with most small household appliances, electronic products, mobile phones and portable computing devices. The combined wall outlet extender and remote control light is connectable with any type of such indoor wall outlet. The insert pins 5 are plugged into the socket arranged on a lower portion of the wall outlet, and the fixing pin 7 is plugged into the other socket, making a connection of the combined wall outlet extender and remote control light to the wall outlet stable.

Figure 4:
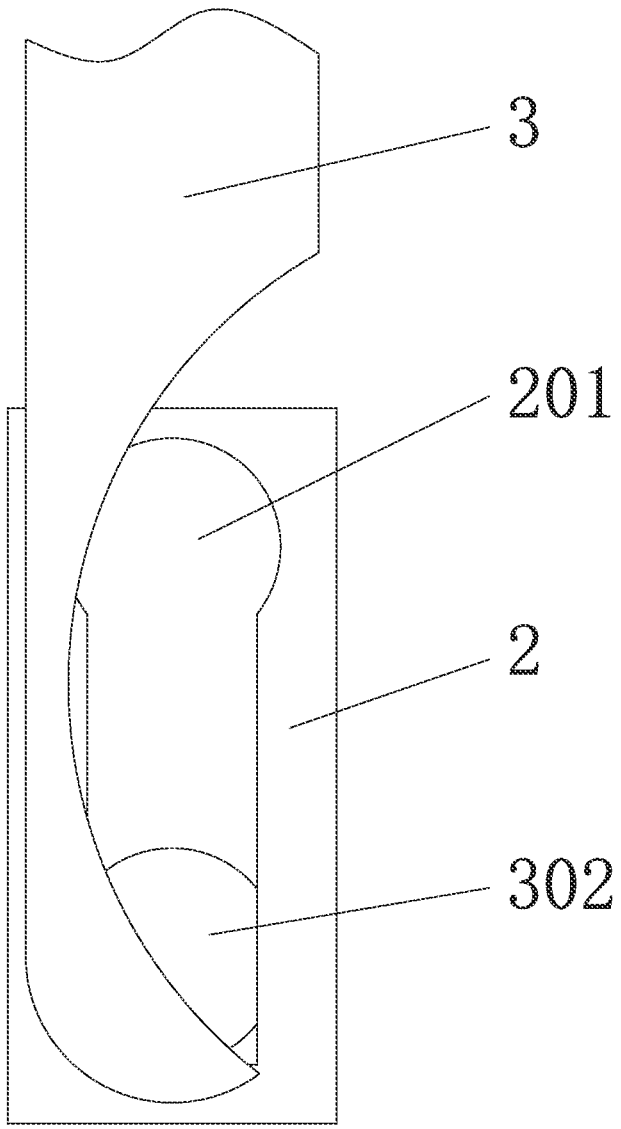
FIG. 4 is a right side cross-sectional schematic diagram showing a position where the protective cover and an upper cover is connected.

As shown in FIG. 4, sliding grooves 201 are arranged on a left side and a right side of the upper cover 2. Each of the sliding grooves 201 comprises an upper section and a lower section. A cross section of the upper section of each of the sliding grooves is circular. A cross section of the lower section of each of the sliding grooves is rectangular. Convex blocks 302 are fixedly connected with the left side and the right side of the protective cover 3. The convex blocks are of a shape of the circular cross section of the upper section minus the left and right sides. Each of the convex blocks is rotatably connected with a corresponding upper section of the sliding grooves. When the protective cover 3 is in a vertical state, each of the convex blocks 302 is slidably connected in a corresponding lower section of the sliding grooves 201.

The protective cover 3 further comprises a buckle 301, and an opening matched with the buckle 301 is defined on the upper cover 2. A position of the opening is corresponding to the buckle 301. When the protective cover 3 is turned over to cover the upper cover 2, the buckle 301 is snapped on the upper cover 2. When the protective cover 3 is vertically turned upwards, and then the protective cover 3 is moved downward, and the convex blocks 302 are slidably connected with the lower sections of the sliding grooves 201 to fix the protective cover 3, so the protective cover 3 is unable to be turned over, and the components provided on the upper cover 2 are not shielded and are able to be used.

Figure 3:
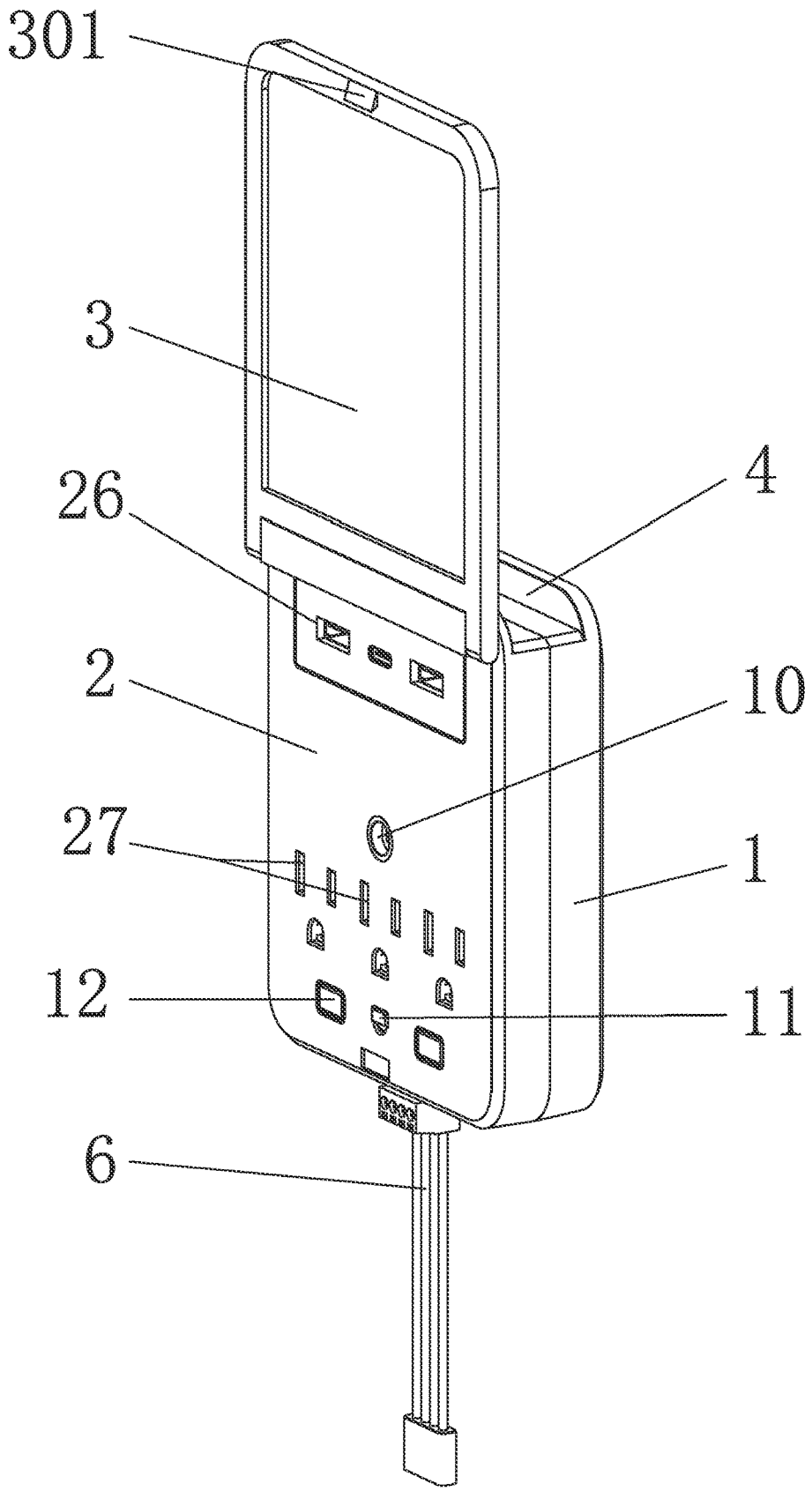
FIG. 3 is a front schematic diagram showing the structure of the combined wall outlet extender and remote control light of the present disclosure where a protective cover is in an open state.

As shown in FIG. 3, in order to make the wall outlet extender and remote control light of the present disclosure realize multiple functions, the upper cover 2 and an upper end of the lower cover 1 are combined to form a slot 4. The slot 4 is configured to place a mobile device such as a mobile phone. A lampshade 10, button caps 12, USB interface through holes 26, and alternating current (AC) port through holes 27 are arranged on the upper cover 2. Specifically, there are two or more USB interface through holes 26 on the upper cover and there are two or more AC output ports on the upper cove 2. The USB interfaces are configured to charge various electronic communication devices, such as mobile phones and tablets. The AC output ports are configured to connect with small household appliances. Therefore, it is avoided that the combined wall outlet extender and remote control light occupies the wall outlet and makes other household appliances no sockets to connect.

Figure 5:
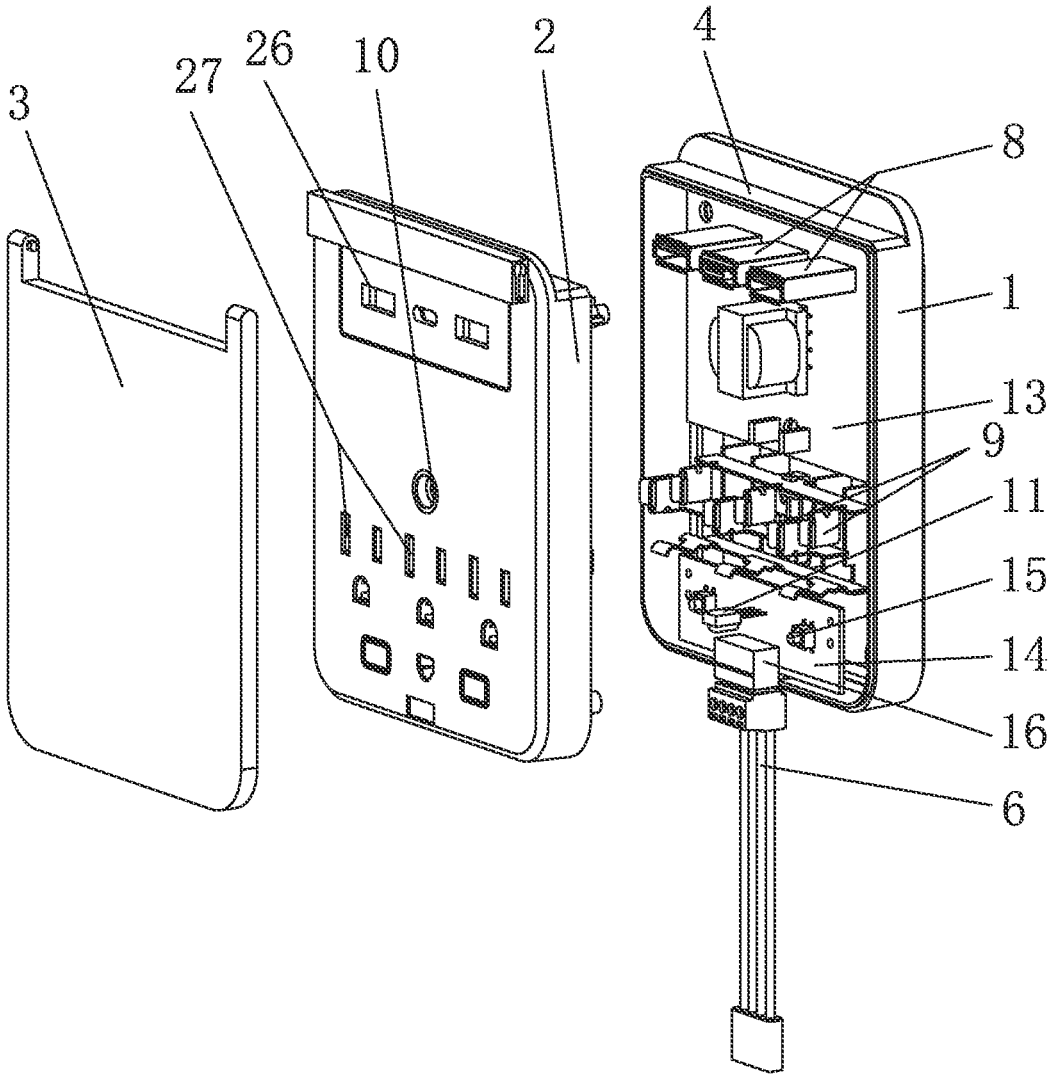
FIG. 5 is an exploded schematic diagram of the combined wall outlet extender and remote control light of the present disclosure.

As shown in FIG. 5, an interior connecting structures of the combined wall outlet extender and remote control light are illustrated. A main control print circuit board (PCB) 13 is fixedly installed in the lower cover 1. An indicator light is arranged on the main control PCB 13. The indicator light is configured to show whether the combined wall outlet extender and remote control light of the present disclosure is powered on. The lampshade 10 is arranged on a position of the upper cover 2 corresponding to the indicator light. USB interfaces 8 are welded with the main control PCB 13. The USB interfaces 8 are built in the upper cover 2 corresponding to a position of the USB interface through holes 26. AC output ports 9 are welded with the main control PCB 13. The AC output ports 9 are built in the upper cover 2 corresponding to a position of the AC output port through holes 27. The insert pins 5 are electrically connected with the AC output ports 9. A remote control PCB 14 is arranged in the lower cover 1. Buttons 15 are welded with the remote control PCB 14. Specifically, there are two buttons 15 arranged on the remote control PCB. A first button is configured to turn on or turn off the light strip 28. A second button is configured to control luminous effect modes of the light strip 28. The button caps 12 are arranged on a position of the upper cover 2 corresponding to the buttons 15. The infrared receiver 11 is welded with the remote control PCB 14 and the infrared receiver 11 is built in the upper cover 2. The remote control PCB 14 is welded with a female wiring terminal 16. The power cord is plugged into the female wiring terminal 16. The remote control PCB 14 is wirelessly connected with a remote controller, such as the mobile phone, so that the user can also download a specified application on a mobile phone client of the mobile phone, and use the mobile phone to remotely control a switch of the light strip 28 and the luminous effect modes of the light strip 28, which is convenient to use.

Figure 6:
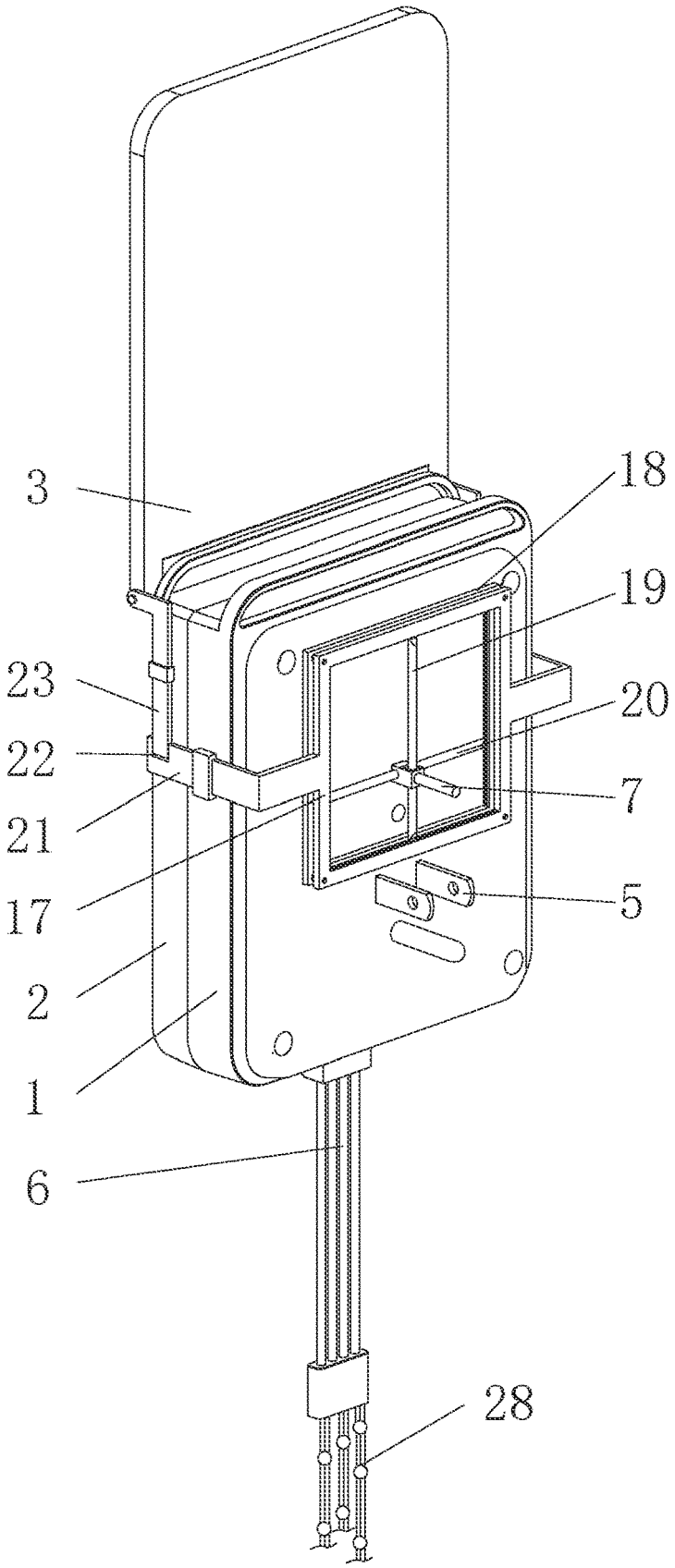
FIG. 6 is a schematic diagram showing a structure of the combined wall outlet extender and remote control light at a position of a fixing pin.

As shown in FIG. 6, there are various duplex outlets arranged on the wall. In order to make the fixing pin 7 suitable for inserting into various types of duplex outlets, a structure of the fixing pin 7 is further improved. In the present disclosure, a specific structure and implementation of the fixing pin 7 is illustrated.

A rear frame 18 is fixedly connected with the lower cover 1. A front frame 17 is arranged on the rear frame 18. A size of the rear frame 18 is same as a size of the front frame 17. A horizontal rod 20 is vertically slidably connected with the rear frame 18. A vertical rod 19 is horizontally slidably connected with the front frame 17. A positioning block 24 slidably connected with the vertical rod 19 and the horizontal rod 20 is arranged on the horizontal rod 20. The fixing pin 7 is fixedly connected with the positioning block 24. The positioning block 24 moves arbitrarily within a range defined by the front frame 17, so that the fixing pin 7 is insertable into different types of duplex outlets, thereby making the combined wall outlet extender and remote control light of the present disclosure widely used.

Figure 7:
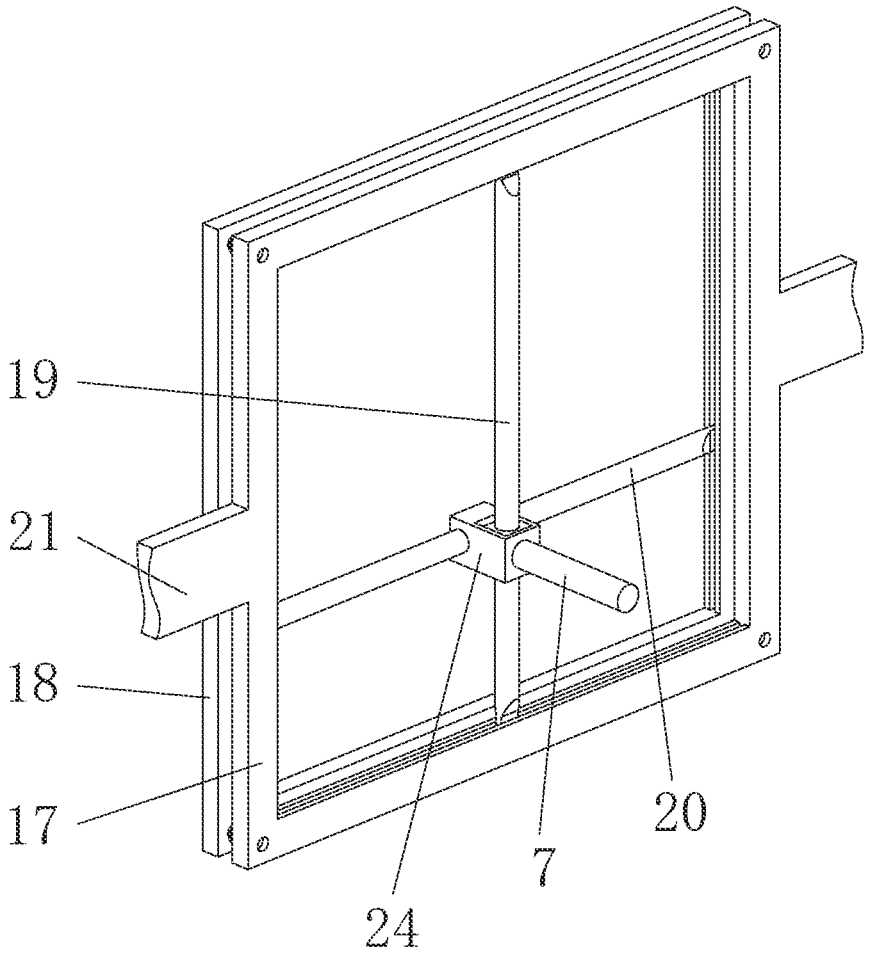
FIG. 7 is a schematic diagram showing the structure of the combined wall outlet extender and remote control light at a position of a front frame.
Figure 8:
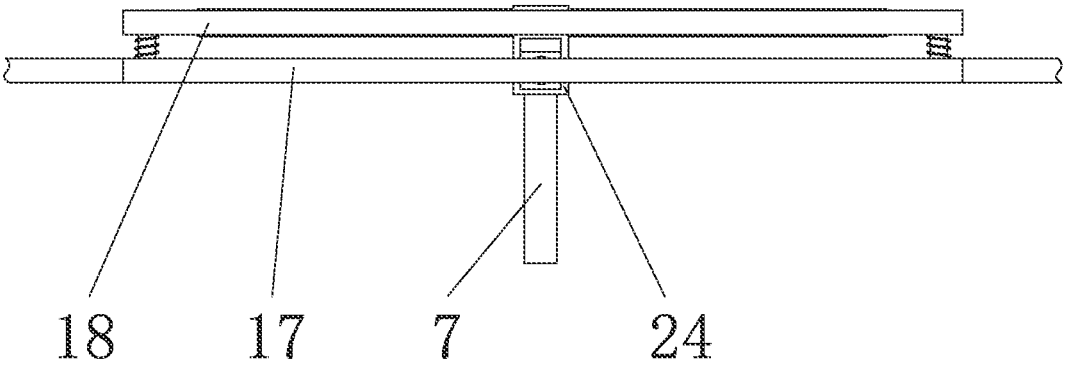
FIG. 8 is a top schematic diagram showing the combined wall outlet extender and remote control light at the position of the front frame.
Figure 9:
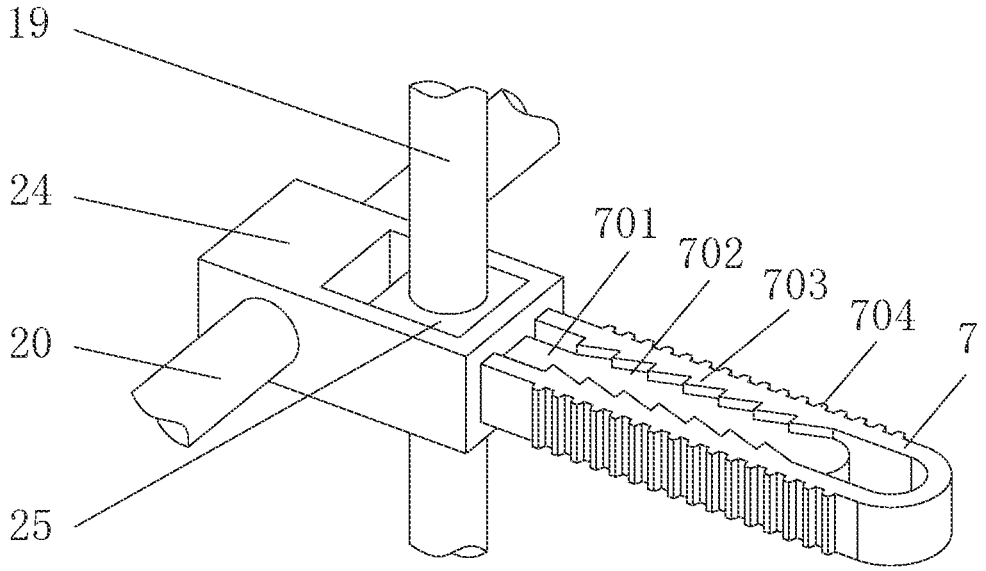
FIG. 9 is a schematic diagram of a first embodiment of a fastening mechanism of the combined wall outlet extender and remote control light.

As shown in FIGS. 7-9, the rear frame 18 is separated from the front frame 17. The front frame 17 is slidably resettable connected with the rear frame 18. Positioning columns are arranged on the rear frame 18. The front frame 17 is slidably connected with the rear frame 18 via the positioning columns. A reset spring is arranged on a corresponding positioning column to realize reset of the front frame 17. The front frame 17 comprises connecting frames 21 slidably connected with two sides of the lower cover 1. Locking openings 22 are on the connecting frames 21. Locking blocks 23 are slidably connected with two sides of the upper cover 2. An upper end of each of the locking blocks 23 is hinged to a rotation center of a corresponding convex block 302 arranged on the protective cover 3. When the protective cover 3 rotates, the locking blocks 23 do not move, and when the protective cover 3 moves downward, the locking blocks 23 are driven to move downward. A lower end of each of the locking blocks 23 is matched with a corresponding locking opening 22 of the connecting frames 21. After the front frame 17 is pressed to move toward the rear frame 18, the locking blocks 23 are inserted downward into the locking openings 22. A sliding block 25 is slidably connected with the positioning block 24. The sliding block 25 is slidably connected with the vertical rod 19. When the front frame 17 moves along the rear frame 18, the front frame 17 drives the sliding block 25 to move in the positioning block 24. The fixing pin 7 is hollow. A fastening mechanism arranged in the fixing pin 7 is fixedly connected with the sliding block 25.

As show in FIG. 9, in a first embodiment of the fastening mechanism, the fastening mechanism comprises an inner core 701, and the inner core 701 arranged in the fixing pin 7 is fixedly connected with the sliding block 25. That is, the inner core 701 is slidably connected with the positioning block 24. A plurality of first abutting blocks 702 are arranged on a left side and a right side of the inner core 701. A plurality of second abutting blocks 703 corresponding to the plurality of first abutting blocks 702 are arranged on inner sides of the fixing pin 7. The fixing pin 7 is made of elastic deformable materials. When the sliding block 25 moves, it drives the inner core 701 to move, which in turn drives the first abutting blocks 702 on the inner core 701 and the second abutting blocks 703 on the fixing pin 7 to abut against each other and move together. Since the fixing pin 7 is made of elastic deformable materials, the fixing pin 7 expands and deforms outward, thereby making the fixing pin 7 expanding in the socket on the wall outlet and making the fixing pin 7 clamping on the wall outlet tightly.

As shown in FIG. 9, a structure of the fixing pin 7 is illustrated. A plurality of clamping strips 704 are arranged on two outer sides of the fixing pin 7. The clamping strip 704 is clamped with the socket on the wall outlet, so that the fixing pin 7 is clamped tightly.

Figure 10:
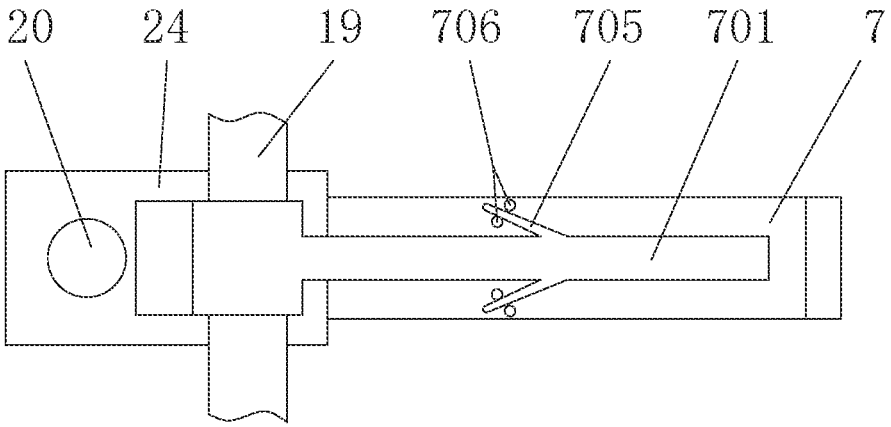
FIG. 10 is a right side cross-sectional schematic diagram of a second embodiment of the fastening mechanism of the combined wall outlet extender and remote control light.

As shown in FIG. 10, in a second embodiment of the fastening mechanism, the fastening mechanism comprises the inner core 701. The inner core 701 arranged in the fixing pin 7 is fixedly connected with the sliding block 25. Limiting bars 705 are arranged on an upper side and a lower side of the inner core 701. The limiting bars 705 are made of elastic deformable materials. Limiting blocks 706 matched with the limiting bars 705 are arranged on the fixing pin 7. When the inner core moves, the limiting bars deform and slide on the limiting blocks to extend out of the fixing pin. The limiting blocks 706 are configured to limit the limiting bars 705 so that the limiting bars are elastically deformed within a predetermined track range when moving. When the inner core 701 moves, the limiting bars 705 slide on the limiting blocks 706 and deforms to extend out of the fixing pin 7. Therefore, when the combined wall outlet extender and remote control light has a tendency to loosen outward, the limiting bars 705 fixed on the fixing pin 7 are clamped on the socket of the wall outlet, thereby preventing the combined wall outlet extender and remote control light from loosening.

A working principle of the present disclosure is as follow. The insert pins 5 are inserted into the socket arranged on the lower portion of the wall duplex outlet, and then the positioning block 24 is moved to adjust a position of the positioning block 24, so that the fixing pin 7 on the positioning block 24 is inserted into the socket arranged on an upper portion of the duplex outlet. The front frame 17 is in contact with a surface of the duplex outlet, and the front frame 17 is squeezed, thereby the front frame 17 is driven to move on the rear frame 18. Then the protective cover 3 is turned over and moved down, so that the convex blocks 302 on the protective cover 3 move from the upper sections of the sliding grooves 201 to the lower sections of the sliding grooves 201, so that the protective cover 3 is fixed to stop moving.

The protective cover 3 moves downward while driving the locking blocks 23 to move downward, and then drives the locking blocks 23 to insert into the locking openings 22 of the connecting frames 21 to lock, so as to lock the front frame 17. The protective cover 3 is opened to use the combined wall outlet extender and remote control light of the present disclosure. The USB interface through holes 8, AC output port through holes, etc. are arranged on the upper cover, and the slot 4 is arranged on the upper end of the upper cover 2 and the lower cover 1 to place the mobile device such as the mobile phone, thereby avoiding a problem of a single function of the combined wall outlet extender and remote control light. The protective cover 3 is regarded as an extension of the slot 4 after being turned over, which further prevent the mobile device from falling from the slot 4 in a situation that the slot 4 is too shallow for some mobile devices. A weight of the mobile device such as the mobile phone placed on the slot 4 makes the combined wall outlet extender and remote control light of the present disclosure easy to loosen, and the fastening mechanism is arranged on the fixing pin 7 so that the combined wall outlet extender and remote control light is firmly inserted into the socket on the wall outlet.

By arrangement of the first embodiment of the fastening mechanism, when the sliding block 25 moves, it drives the inner core 701 to move, which in turn drives the first abutting blocks 702 on the inner core 701 and the second abutting blocks 703 on the fixing pin 7 to abut against each other and move together. Since the fixing pin 7 is made of elastic deformable materials, the fixing pin 7 expands and deforms outward, thereby making the fixing pin 7 expanding in the socket on the wall outlet and making the fixing pin 7 clamping on the wall outlet tightly.

By arrangement of the first embodiment of the fastening mechanism, when the inner core 701 moves, the limiting bars 705 slide on the limiting blocks 706 and deforms to extend out of the fixing pin 7. Therefore, when the combined wall outlet extender and remote control light has a tendency to loosen outward, the limiting bars 705 fixed on the fixing pin 7 are clamped on the socket of the wall outlet, thereby preventing the combined wall outlet extender and remote control light from loosening.

What is claimed is:

1. A combined wall outlet extender and remote control light, comprising:

a lower cover;

an upper cover arranged on the lower cover and matched with the lower cover;

insert pins arranged on the lower cover;

a power cord configured to connect with a light strip and arranged on a bottom portion of the upper cover; and an infrared receiver passing through the upper cover;

wherein a protective cover is arranged on an upper end of the upper cover; the protective cover is configured to protect components arranged on the upper cover; a fixing pin is arranged on the lower cover;

wherein a rear frame is fixedly connected with the lower cover; a front frame is arranged on the rear frame; a horizontal rod is vertically slidably connected with the rear frame; a vertical rod is horizontally slidably connected with the front frame; a positioning block slidably connected with the vertical rod and the horizontal rod is arranged on the horizontal rod; the fixing pin is fixedly connected with the positioning block.

2. The combined wall outlet extender and remote control light according to claim 1, wherein the rear frame is separated from the front frame; the front frame is slidably resettable connected with the rear frame; the front frame comprises connecting frames slidably connected with two sides of the lower cover; locking openings are on the connecting frames; locking blocks are slidably connected with two sides of the upper cover; an upper end of each of the locking blocks is hinged to a rotation center of a corresponding convex block arranged on the protective cover; a lower end of each of the locking blocks is matched with a corresponding locking opening of the connecting frames; a sliding block is slidably connected with the positioning block; the sliding block is slidably connected with the vertical rod; the fixing pin is hollow; a fastening mechanism arranged in the fixing pin is fixedly connected with the sliding block.

3. The combined wall outlet extender and remote control light according to claim 2, wherein the fastening mechanism comprises an inner core, and the inner core arranged in the fixing pin is fixedly connected with the sliding block; a plurality of first abutting blocks are arranged on a left side and a right side of the inner core; a plurality of second abutting blocks corresponding to the plurality of first abutting blocks are arranged on inner sides of the fixing pin; the fixing pin is made of elastic deformable materials.

4. The combined wall outlet extender and remote control light according to claim 3, wherein a plurality of clamping strips are arranged on two outer sides of the fixing pin.

5. The combined wall outlet extender and remote control light according to claim 2, wherein the fastening mechanism comprises an inner core, the inner core arranged in the fixing pin is fixedly connected with the sliding block; limiting bars are arranged on an upper side and a lower side of the inner core; the limiting bars are made of elastic deformable materials; limiting blocks matched with the limiting bars are arranged on the fixing pin; when the inner core moves, the limiting bars deform and slide on the limiting blocks to extend out of the fixing pin.

6. A combined wall outlet extender and remote control light, comprising:

a lower cover;

an upper cover arranged on the lower cover and matched with the lower cover;

insert pins arranged on the lower cover;

a power cord configured to connect with a light strip and arranged on a bottom portion of the upper cover; and an infrared receiver passing through the upper cover;

wherein a protective cover is arranged on an upper end of the upper cover; the protective cover is configured to protect components arranged on the upper cover; a fixing pin is arranged on the lower cover;

wherein sliding grooves are arranged on a left side and a right side of the upper cover; each of the sliding grooves comprises an upper section and a lower section; a cross section of the upper section of each of the sliding grooves is circular; a cross section of the lower section of each of the sliding grooves is rectangular; convex blocks are fixedly connected with a left side and a right side of the protective cover; each of the convex blocks is rotatably connected with a corresponding upper section of the sliding grooves; each of the convex blocks is slidably connected with a corresponding lower section of the sliding grooves; the protective cover further comprises a buckle; an opening matched with the buckle is defined on the upper cover; a position of the opening is corresponding to the buckle.

7. A combined wall outlet extender and remote control light, comprising:

a lower cover;

an upper cover arranged on the lower cover and matched with the lower cover;

insert pins arranged on the lower cover;

a power cord configured to connect with a light strip and arranged on a bottom portion of the upper cover; and an infrared receiver passing through the upper cover;

wherein a protective cover is arranged on an upper end of the upper cover; the protective cover is configured to protect components arranged on the upper cover; a fixing pin is arranged on the lower cover;

wherein the upper cover and an upper end of the lower cover are combined to form a slot; a lampshade, button caps, USB interface through holes and alternating current (AC) port through holes are arranged on the upper cover.

8. The combined wall outlet extender and remote control light according to claim 7, wherein a main control print circuit board (PCB) is fixedly installed in the lower cover; an indicator light is arranged on the main control PCB; the lampshade is arranged on a position of the upper cover corresponding to the indicator light; USB interfaces are welded with the main control PCB; the USB interfaces are built in the upper cover corresponding to a position of the USB interface through holes; AC output ports are welded with the main control PCB; the AC output ports are built in the upper cover corresponding to a position of the AC output port through holes; the insert pins are electrically connected with the AC output ports; a remote control PCB is arranged in the lower cover; buttons are welded with the remote control PCB; the button caps are arranged on a position of the upper cover corresponding to the buttons; the infrared receiver is welded with the remote control PCB and the infrared receiver is built in the upper cover; the remote control PCB is welded with a female wiring terminal; the power cord is plugged into the female wiring terminal.

* * * * *